United States Patent [19]

Balocca et al.

[11] 4,054,228

[45] Oct. 18, 1977

[54] CAN END CLOSURE HAVING FIRST AND SECOND SEALING MEANS

[75] Inventors: Alfred E. Balocca, Wheaton; Paul W. Hardy, Barrington, both of Ill.

[73] Assignee: American Can Company, Greenwich, Conn.

[21] Appl. No.: 783,718

[22] Filed: Apr. 1, 1977

[51] Int. Cl.[2] ..... B65D 41/32

[52] U.S. Cl. ..... 220/268; 220/334; 220/359

[58] Field of Search ..... 220/265, 268, 334, 359, 220/367, 266; 222/541; 229/7 R

[56] References Cited

U.S. PATENT DOCUMENTS

| | | | |
|---|---|---|---|
| 3,952,912 | 4/1976 | Perry | 220/268 |
| 3,958,717 | 5/1976 | Ellis | 220/268 |
| 3,972,445 | 8/1976 | Debenham | 220/268 |

*Primary Examiner*—George T. Hall

*Attorney, Agent, or Firm*—Robert P. Auber; George P. Ziehmer; Ira S. Dorman

[57] ABSTRACT

The instant invention relates to an end closure or cover for a metal container comprising a substantially flat sheet metal lid seamed about its extremity to the container body closing the end thereof. The lid has a pour opening having a closure hingedly connected to the lid and closing the pour opening, and wherein first and second sealing means are provided to seal the closure and to provide resistance of the closure to atmospheric pressure and premature opening of the container.

6 Claims, 5 Drawing Figures

FIG. 1
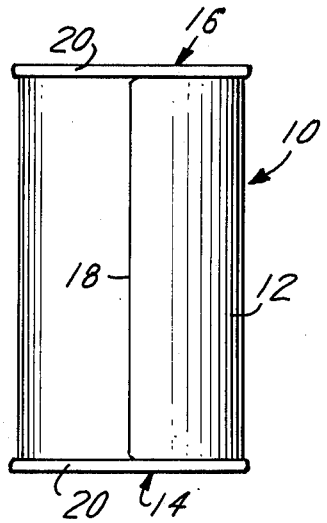
FIG. 2
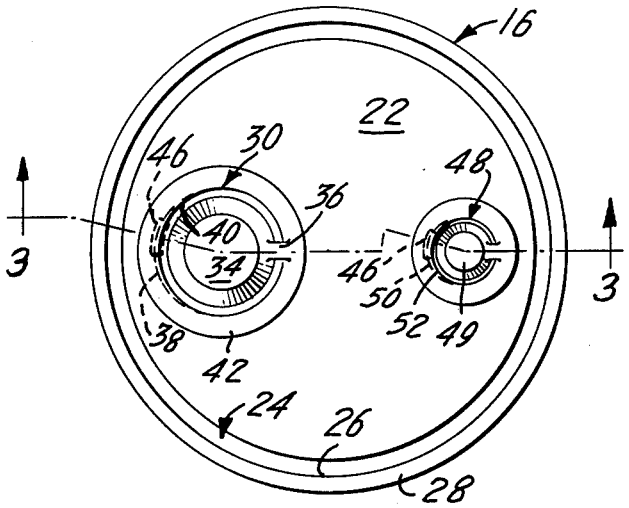
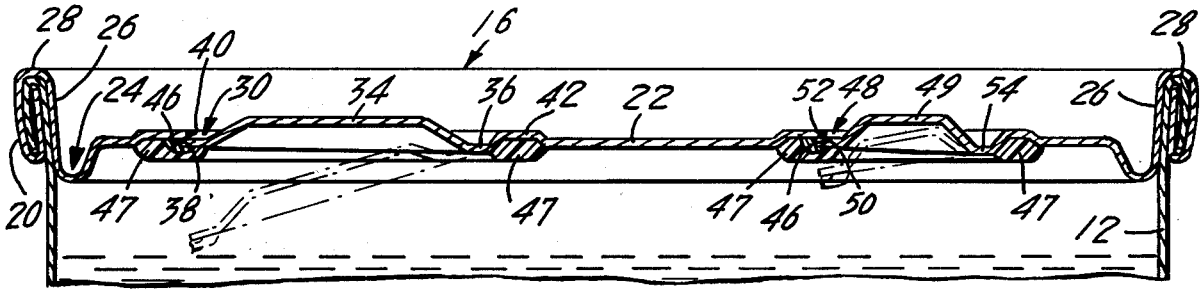
FIG. 3
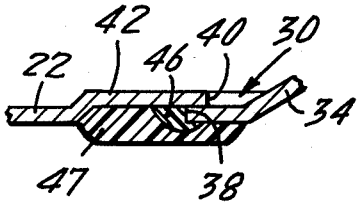
FIG. 4
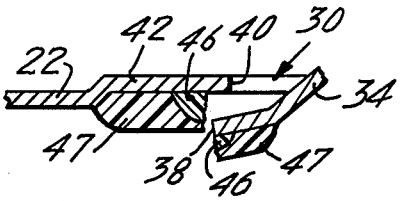
FIG. 5

CAN END CLOSURE HAVING FIRST AND SECOND SEALING MEANS

BACKGROUND OF THE INVENTION

The present invention relates generally to end closures for metal containers and more particularly to can end closures which have improved sealing means while retaining easy opening features.

There has been a continuing demand for a lid construction for such cans which may be opened without the use of separate opening devices. One such construction, generally termed the "pull-tab," embodies a scored gate outline in the surface of the can lid and a supplemental lever attached to the gate portion to facilitate breaking the gate portion along the scored outline and lifting it from the can end. However, this type construction has several inherent disadvantages. One such disadvantage relates to the possibility of minor injuries resulting from contact with the edges of the opening or of the discarded pull-tab. A further disadvantage of such construction relates to ecology, and involves the rather prevalent indifference as to the proper disposal of the detached tabs, causing complaints of injury and litter and promoting legislation directed at the banning of such containers.

Another type of can end construction which has been proposed in recent years is the push-in tab type. Examples of can end construction of this type can be found disclosed in U.S. Pat. No. 3,227,304 to Asbury, granted Jan. 4, 1966, U.S. Pat. No. 3,362,569, to Geiger, granted Jan. 9, 1968, U.S. Pat. No. 3,334,775, to Klein et al., granted Aug. 8, 1967, and U.S. Pat. No. 3,759,206, Dalli et al., granted Sept. 18, 1973.

The Asbury patent discloses a can opening arrangement which embodies a can end having score lines which may define two equal-size, inwardly-displaceable tab portions or scored regions in the can end.

The Geiger patent is somewhat similar to the Asbury patent, and discloses a pair of substantially identical raised tabs which are depressable into the can body. Unlike the Asbury patent, however, Geiger does not utilize a score mark to define tab portions and to produce a weakening in the can end; rather, the patent comprehends partial shearing of the can end to offset and weaken the metal defining the tab portions. The partial shear leaves a residual wall section which is intended to break when the tab portion is depressed.

The Klein et al. patent discloses a push-in opening feature similar to the Asbury and Geiger patents in that a score mark is utilized for breaking the tab portion or panel away from the can end. A feature in the Klein et al. patent differing from the Asbury and Geiger patents is that the tab panel is formed integrally with the can end by underfolding the panel 180° outwardly and about the opening, to form a narrow spacer strip at the underside of the can end about the edge of the opening, the score mark being located at the underfold and away from the opening. Thus, the possibility of minor injury resulting from the edge of the opening is eliminated by the Klein et al. construction.

Finally, the Dalli et al. patent describes a can end closure from which portions are preferably partially severed to form two similarly dimensioned and configured openings, and to provide corresponding closure members.

Henchert et al., in U.S. Pat. No. 3,251,515, discloses a container closure provided with two openings of different sizes, which are closed by slugs stamped from the end panel and secured to a peelable strip or tape.

A hybrid sort of closure arrangement is taught in Dunn et al. U.S. Pat. No. 3,441,169, consisting of a relatively small, inwardly-displaceable vent area, and a rather conventional removable tear strip.

It is, therefore, a primary object of the present invention to provide an improved easy open can end closure with new and improved sealing means and which eliminates in whole or in part the disadvantages inherent in the can end closures discussed above.

More specifically, it is an object of the invention to provide novel sealing means for a can end closure having facile opening features.

SUMMARY OF THE DISCLOSURE

The instant invention relates to a can end closure comprising a central panel having a pour opening and a closure dimensioned and configured to close the pour opening. Hinge means is provided for manually displaceably mounting the closure on the panel with first sealing means positioned exclusive, and spaced apart in a localized area, from the hinge means, and with second sealing means sealingly engaged across the pour opening. The first sealing means is positioned beneath the second sealing means and is of higher tensile strength than the second sealing means.

BRIEF DESCRIPTION OF THE DRAWINGS

The present invention will be described and understood more readily when considered together with the embodiment of the accompanying drawings, in which:

FIG. 1 is an elevational view of a can having an upper end closure.

FIG. 2 is a top plan view of the can of FIG. 1, drawn to an enlarged scale showing the sealing means of the present invention.

FIG. 3 is a fragmentary cross-sectional view of the upper portion of the can of FIG. 1, taken along line 3—3 of FIG. 2 and drawn to an enlarged scale showing the sealing means of the present invention;

FIG. 4 is a fragmentary cross-sectional view to an enlarged scale of a portion of the upper end closure of the foregoing figures with the tab illustrated shown in closed position and sealed with sealing means of the present invention.

FIG. 5 is a view similar to FIG. 4, with the tab shown in an open position.

DETAILED DESCRIPTION OF THE ILLUSTRATED EMBODIMENTS

Construction of the can end closure may be similar to the type as disclosed in, for example, U.S. Ser. No. 497,711, filed Aug. 15, 1974, to which reference is hereinafter made.

Referring now to the drawings in detail, FIG. 1 thereof shows a can, designated by the numeral 10, having a cylindrical wall 12 enclosed by a flat circular bottom lid and a top lid or end cover; the bottom and top lids being generally designated by the numerals 14 and 16, respectively. The cylindrical wall 12 may be formed from a rectangular sheet metal blank by joining opposite edges thereof at seam 18, or it may be formed by drawing and ironing a circular blank to produce a seamless container body having an integral bottom wall. The peripheries of lids 14 and 16 are joined to the respective ends of cylindrical wall 12 by conventional folded inter-connecting seams. The structures comprising cylindrical wall 12 and bottom lid 16 are conventional; therefore, further description is unnecessary. The top lid or end cover 14, which incorporates the improved push-in opening features of the present invention, is also conventional in its general form and in the manner in which it is joined to the end of cylindrical wall 12 by seam 20.

As clearly seen in FIGS. 2 and 3, lid or end cover 14 is formed with a generally planar central panel 22 surrounded by a peripheral reinforcing groove 24, which merges at its outer edge into an upwardly extending wall 26. The upper end portion of wall 26 merges with outwardly extending flange 28 which, after assembly of the cylindrical wall 12 and the end cover 16, becomes a portion of the upper seam. End cover 16 can be fabricated from any suitable sheet metal material, including aluminum and steel.

Can end cover 16 is provided with a relatively large area pour opening, designated generally by the numeral 30. The pour opening 30 is located near the periphery of panel 22 and may be of any convenient shape, such as circular, teardrop, etc. Although there is no criticality in the absolute size of pour opening 30, it may be desirable that it not be so large as to permit the complete insertion of the user's finger, and yet it should be large enough to permit adequate out-flow of the contents of the can 10. Sufficient undisturbed sheet metal must remain between the radially extreme portion of opening 30 and the periphery of panel 22 to provide structural integrity for the opening, so as to preclude buckling of the periphery of the opening under high internal can vacuum.

A relatively large tab, generally designated by the numeral 34, is provided as a closure for pour opening 30. Tab 34 may have a raised central portion, and may be generally dome-shaped with its highest point being located substantially below flange 28 to insure against unintentional depression of tab 34. Tab 34, central panel 22, and bending hinge 36, are integrally formed, with the hinge 36 preferably being positioned radially inwardly from pour opening 30 on central panel 22. It has generally been found that a 0.062 to 0.125 inch wide hinge is sufficient to retain tab 34 to panel 22 and not interfere unduly with ease of opening. The periphery of tab 34, generally designated 38, underlies the periphery 40 of pour opening 30, i.e. that portion of panel 22 which is adjacent to and defines opening 30. The bead 42 is formed about the opening 30 for the purpose of protecting the user's finger or lips from the edge thereof. Bead 42 also provides for reinforcement of the area between opening 30 and groove 24, and it may be formed to extend completely about the opening 30 or interrupted at the hinge 36, as appropriate.

Several methods may be used in forming the metal to achieve the underlying relationship of the tab marginal portion relative to the periphery of the pour opening. Thus, the marginal portion 38 of tab 34 may be held below the periphery 40 of opening 30 and the bead 42 slightly collapsed, to thereby extend the periphery and diminish the size of the opening 30. Alternatively, the tab 34 can be collapsed slightly to thereby extend its marginal portion 38 into underlying relationship with the peripheral portion 40.

In order to open the pour opening 30, the user merely applies force to the tab 34 to displace it inwardly to the position shown in phantom line in FIG. 3, in which position it is maintained during dispensing or drinking of the contents of the can due to the structural support provided by the bending hinge 36.

Sealing means 46 and 47 are provided which cooperate with tab 34 and opening 30 to effect a hermetic seal for the opening 30. Sealing means 47 is provided in any suitable way, such as by sealing compound, plastic tape, adhesive foil, a hot melt material, or other various compounds, later discussed. The sealing means 46 must be sufficiently frangible to be ruptured upon application of manual pressure against the tab 34, as most clearly seen in FIG. 5. Sealing means 46 is provided to cooperate with tab 34 and opening 30. The sealing means 46 is provided in a localized area spaced apart from the bending hinge 36 and is of a higher tensile strength than sealing means 47. The sealing means 46, as shown, is beneath sealing means 47 and in adhesive contact with the surfaces of the tab 34 and the end cover 14 of the can. Thus, sealing means 46 can be first applied and then sealing means 47 applied over sealing means 46 to complete the hermetic seal. Naturally also, if desired, each of these sealing means 46 and 47 can be applied with little or no overlaying with respect to the other so long as a continuous seal is effected.

The effect of the sealing means 46 is to provide additional strength of preferably up to about two additional pounds required opening force to the hermetic seal with vacuum packed cans. It has been found that additional strength is desired to resist atmospheric pressure and the attendant danger of premature opening of the can or flexing of the sealing means and tab 34 inwardly due to atmospheric pressure on the tab 34 with vacuum packed cans, which is unsightly. The sealing means 46 is applied since it has been found that merely increasing the amount of sealing means 47, although providing the higher desired strength, increases the distance of travel of the tab 36 required to break the seal, which is highly undesirable. Since the tab 34 is hingedly attached, the sealing means 46 has its greatest effect at 180° from the bending hinge 36 and progressively decreases when positioned progressively closer to the bending hinge 36 with no effect right at the bending hinge 36. Thus, the sealing means 46 is placed in a localized area and in spaced apart relationship to the hinge 36. Tensile strengths of suitable material would, for example, run generally in the order of 1900 psi to 3000 psi with elongation values generally in the order of 150 to 260%. Naturally the strengthening effect of the relatively higher strength sealing means 46 would also vary according to the amount applied. Naturally also the amount required for the most desired result also depends upon the size of the tab 34. Specifically a relatively large tab would require more of sealing means 46 than a relatively small tab due to the greater surface area of the larger tab exposed to atmospheric pressure.

Since the greatest amount of downward travel of the tab 34 would occur at 180° from the hinge 36 it is preferred that the sealing means 46 have an elongation value in the upper portion of the aforementioned elongation range when applied at or close to 180° from the hinge 36. This is so preferred since, should the cans be subjected to shipping abuse some flexibility will be afforded to the tab 34 for inward movement thereof without rupturing of the sealing means 46.

Typical compounds contemplated for the sealing means 46, as well as for sealing means 47, include, but are not limited to, plastisols comprising a blend of plasticizers, resins, fillers, and stabilizers common to the art of formulation of these compounds. The plasticizers would include the phthalate, adipate, sebacate, citrate, phosphate, glycolate and polyester type but not limited thereto. Typical resins include various particle size polyvinyl chloride, and polyvinyl chloride-acetate copolymers, among other compounds. Fillers, such as barium sulfate, are well known and the stabilizers include such compounds as the fatty acid metal stearates of the calcium and zinc type.

Tests have shown that when, for example, a plastisol comprising polyvinyl chloride and polyvinyl chloride vinyl acetate copolymers, having a tensile strength value of 160–200 psi and an elongation value of 225 to 225%, was employed alone that a force of 10.1 lbs. was required operating through a distance of 0.073 inch to open the can having a circular tab 34 of 0.625 inch diameter. When the higher strength plastisol of these compounds, in a different formulation, was employed at 180° to the hinge 36 as described, the opening force was 11.6 lbs. operating through a distance of 0.055 inch. The higher strength plastisol employed had a tensile strength of 1900 psi to 2700 psi and an elongation value of 175 to 245%, whereas, in comparison the lower strength plastisol, or sealing means 47 in this example, had a tensile strength of from 160 to 200 psi and an elongation value of 225 to 255%. The amount of sealing means 46 applied was in the order of 5–6 mgs. covering a generally circular area of about 3mm. in diameter.

Vent opening 48 which is preferably distantly spaced from pour opening 30, is closed by a raised tab, generally designated by the numeral 49. As can be seen, the tab 49 is of a configuration which is generally similar to that of tab 34, but is of substantially smaller area to conform with the reduced area of the opening 48, which it is dimensioned and configured to close. The periphery 50 of tab 49 is flanged to underlie the periphery 52 of opening 48, as clearly seen in FIG. 3. This is accomplished in much the same manner as described above in connection with the underlying feature of periphery 38 of tab 34 and periphery 40 of opening 30. Tab 49 is integral with central panel 22 through bending hinge 54, and it has been found that a 0.062 to 0.125 inch wide hinge is sufficient to retain the tab 49 to center panel 22 and not interfere unduly with ease of opening. The highest point of tab 49 is substantially lower than flange 28, in order to avoid inadvertent opening of tab 49.

To open the opening 48, force is applied to the upper portion of the raised tab 49, to thereby depress it into the can body 10 and dispose it generally in the phantom line position of FIG. 3. The structural integrity of bending hinge 54 maintains the tab 49 in the open position shown, so that when the contents of can 10 are being poured through pour opening 34 sufficient air will enter through vent opening 48 to replace the outgoing liquid and facilitate pouring. Although, as in the case of pour opening 30, there is no absolute criticality in the size of opening 48, it is preferred that the size of the vent opening be as small as practical; in any event, the area of the vent opening and of the tab closure therefor will be substantially smaller than that of the pour opening and its closure so as to minimize the possibility of spillage through the opening 48. As in the case of pour opening 30, in order to hermetically seal the vent opening 48 and tab 49, sealing means 47 is provided.

Sealing means 46 may also be provided, if desired, as with pour opening 30 in order to insure against premature opening or depressing of the tab 49.

It is understood that the foregoing general and detailed descriptions are explanatory of the present invention and are not to be interpreted as restrictive of the scope of the following claims.

Having thus described the invention, what is claimed is:

1. An end cover for a container comprising, a central panel having a pour opening and a first closure dimensioned and configured to close said pour opening, first hinge means for manually displaceably mounting said first closure on said panel with said first closure sealingly engaged across said pour opening by first sealing means positioned exclusive of said hinge means and including second sealing means sealingly engaged across said pour opening, said first sealing means having a higher tensile strength than said second sealing means and positioned beneath said second sealing means in a localized area spaced apart from said hinge means.

2. The end cover of claim 1 including a vent opening and a second closure dimensioned and configured to close said vent opening, second hinge means for manually displaceably mounting said second closure on said panel, and third sealing means sealing engaging said second closure across said vent opening.

3. The end cover of claim 2 including a fourth sealing means exclusive and spaced apart in a localized area from said second hinge means and sealing engaged across said second closure and said panel and cooperating with said third sealing means to effect a hermetic seal therebetween, said fourth sealing means being positioned beneath said third sealing means.

4. The end cover of claim 2 wherein said first sealing means is present in an amount of from 5 to 6 mgs. distributed over a generally circular area of about 3 mm. in diameter.

5. The end cover of claim 2 wherein said first sealing means is a plastisol having a tensile strength of from 1900 to 2700 psi and an elongation value of from 175 to 245%.

6. The end cover of claim 2 wherein said first sealing means is a plastisol.

* * * * *